United States Patent [19]

Jugle

[11] Patent Number: 4,466,730

[45] Date of Patent: Aug. 21, 1984

[54] DEVELOPMENT APPARATUS

[75] Inventor: Don B. Jugle, Penfield, N.Y.

[73] Assignee: Xerox Corporation, Stamford, Conn.

[21] Appl. No.: 448,141

[22] Filed: Dec. 9, 1982

[51] Int. Cl.[3] ..... G03G 15/08

[52] U.S. Cl. ..... 355/3 DD; 355/14 D; 355/15

[58] Field of Search ..... 355/3 DD, 14 D, 15; 118/657, 658, 652; 366/139; 209/144

[56] References Cited

U.S. PATENT DOCUMENTS

| | | | |
|---|---|---|---|
| 3,098,765 | 7/1963 | Keller et al. | 118/658 X |
| 3,685,485 | 8/1972 | Kutsuwada et al. | 355/3 DD X |
| 3,703,957 | 11/1972 | Swanson et al. | 209/144 |
| 4,029,047 | 6/1977 | Bell | 118/652 |
| 4,053,218 | 10/1977 | Mikolas | 355/15 |
| 4,100,611 | 7/1978 | Jugle | 366/139 |
| 4,194,830 | 3/1980 | Ohnuma et al. | 355/3 DD |
| 4,337,724 | 7/1982 | Hosono et al. | 355/3 DD X |

FOREIGN PATENT DOCUMENTS 1052019 12/1966 United Kingdom .

*Primary Examiner*—A. C. Prescott

*Attorney, Agent, or Firm*—H. Fleischer; J. E. Beck; R. Zibelli

[57] ABSTRACT

An apparatus in which an electrostatic latent image recorded on a photoconductive member is developed. A supply of developer material comprising at least toner particles and carrier granules is stored and transported closely adjacent to the electrostatic latent image recorded on the photoconductive member. The quantity of developer material being transported to the electrostatic latent image recorded on the photoconductive member is controlled by a metering blade. At least accumulation of toner particles adjacent the blade is prevented and a flow of toner particles away from the blade induced. In this way, the escape of toner particles from the storage chamber thereof is substantially minimized.

8 Claims, 5 Drawing Figures

DEVELOPMENT APPARATUS

This invention relates generally to an electrophotographic printing machine, and more particularly to a development system which minimizes the escape of at least the toner particles of the developer material therefrom.

In a typical electrophotographic printing machine, a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Generally, the developer material is made from a mixture of carrier granules and toner particles. The toner particles adhere triboelectrically to the carrier granules. This two-component mixture is brought into contact with the latent image. Toner particles are attracted from the carrier granules to the latent image forming a powder image thereof. Hereinbefore, the toner particles contained within the development system frequently escaped therefrom resulting in contamination of the printing machine. This produced degradation of copy quality and frequently resulted in excessive service calls. Moreover, the environment surrounding the various processing stations within the printing machine would invariably become dirty or coated with particles. In the development system, a magnetic brush developer roller transports developer material closely adjacent to the photoconductive surface. A metering blade regulates the thickness of the layer of developer material adhering to the developer roller. It has been found that a fairly thick layer of toner particles forms on the metering blade. The accumulation of toner particles on the metering blade provides a source thereof at least a part of which may escape from the development system resulting in contamination of the surrounding subassemblies within the printing machine.

Various techniques have been devised for preventing the escape of toner particles from the development system. The following disclosures appear to be relevant:

U.S. Pat. No. 3,098,765; Patentee: Keller et al.; Issued: July 23, 1963.

U.S. Pat. No. 3,685,485; Patentee: Kutsuwada et al.; Issued: Aug. 22, 1972.

U.S. Pat. No. 3,703,957; Patentee: Swanson et al.; Issued: Nov. 28, 1972.

U.S. Pat. No. 4,029,047; Patentee: Bell; Issued: Oct. 28, 1975.

U.S. Pat. No. 4,053,218; Patentee: Mikolas; Issued: Oct. 11, 1977.

U.S. Pat. No. 4,100,611; Patentee: Jugle; Issued: July 11, 1978.

British Pat. No. 1,052,019; Patentee: Lawes; Published: Dec. 21, 1966.

The pertinent portions of the foregoing disclosures may be briefly summarized as follows:

Keller et al. and Mikolas describe metering blades for regulating the thickness of developer material adhering to a developer roller used in a magnetic brush development system.

Kutsuwada et al. discloses a development station wherein a developer roller transports particles to a latent image recorded on a photoconductive member. A fan maintains a negative pressure within the development station so as to prevent particles from escaping therefrom. A filter catches any scattered particles to prevent them from escaping the development system.

Swanson et al. discloses a copying machine having a particle conveying system including a plurality of pneumatic ducts and a blower. A vacuum-type pickup device is attached to the blower and positioned to remove loose particles from the copy sheets exiting the machine. The pneumatic system includes a centrifugal separator to receive the particles from the vacuum pickup. The centrifugal separator separates the particles from the air and collects the particles in the chamber for subsequent re-use. The air exiting the separator passes through a filter prior to returning to the atmosphere.

Bell describes a system for reclaiming residual toner particles removed from a photoreceptor. A blower removes air and toner from a photoreceptor cleaner. The toner is separated from the moving air and stored for re-use with the clean air being vented to the atmosphere.

Jugle describes a development system having a filter disposed in a wall thereof and a vacuum system associated therewith for maintaining the chamber of a development system at a negative pressure to prevent the escape of particles therefrom. The developer material flows over the filter and cleans particles therefrom.

Lawes discloses a photoreceptor cleaning system having brush rollers for removing the residue of powder images from the photoreceptor. The dust laden air is driven by a fan through a filter or electrostatic precipitator from which the dust may be recovered.

In accordance with one aspect of the features of the present invention, there is provided an apparatus for developing an electrostatic latent image recorded on a photoconductive member. Means, defining a chamber, store a supply of developer material comprising at least carrier granules and toner particles therein. Means, disposed in the chamber of the storing means, transport developer material closely adjacent to the electrostatic latent image recorded on the photoconductive member. Means control the quantity of developer material being transported by the transporting means to the electrostatic latent image recorded on the photoconductive member. Means prevent the accumulation of at least the toner particles adjacent the controlling means and induce a flow of toner particles away from the controlling means.

Pursuant to another aspect of the present invention, there is provided an electrophotographic printing machine of the type having an electrostatic latent image recorded on a photoconductive member. Means, defining a chamber, are provided for storing a supply of developer material comprising at least carrier granules and toner particles therein. Means, disposed in the chamber of the storing means, transport the developer material closely adjacent to the electrostatic latent image recorded on the photoconductive member. Means control the quantity of developer being transported by the transporting means to the electrostatic latent image recorded on the photoconductive member.

Means prevent the accumulation of at least the toner particles adjacent the controlling means and induce a flow of toner particles away from the controlling means.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
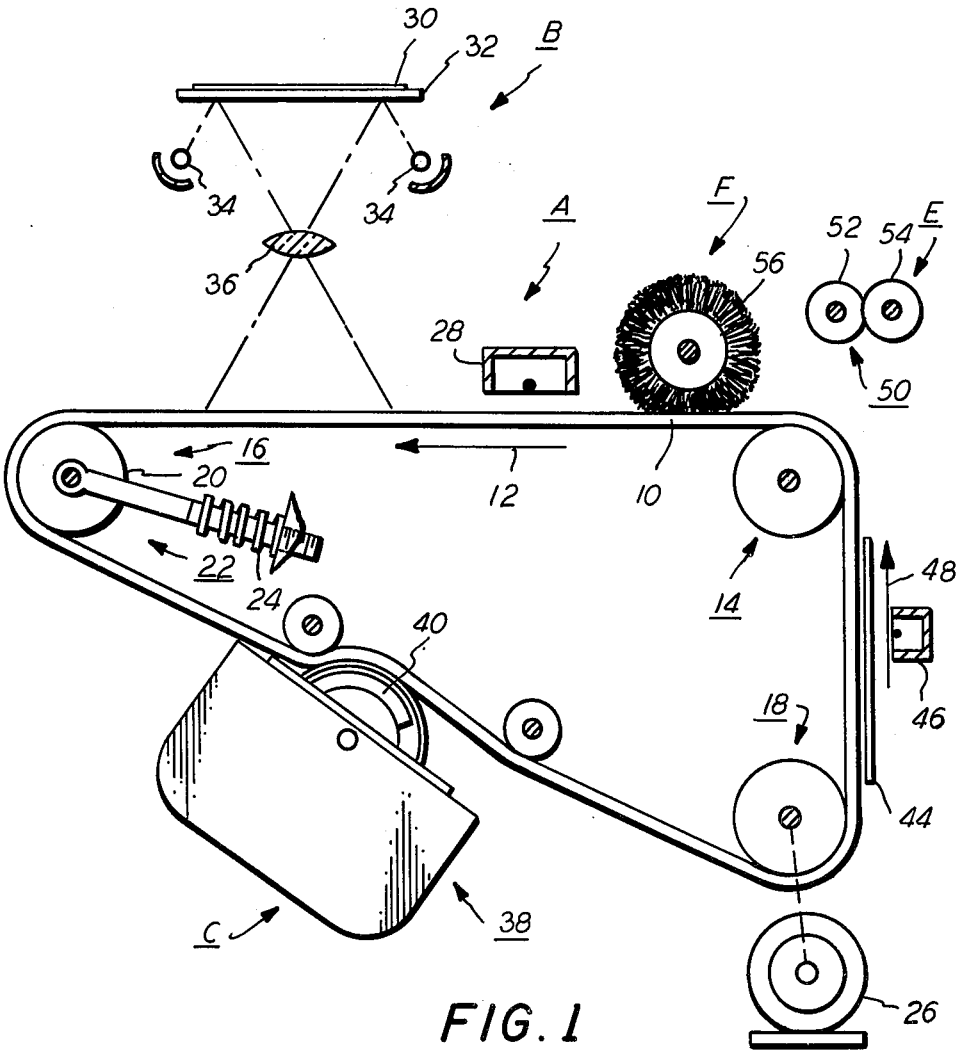
FIG. 1 is a schematic elevational view depicting an electrophotographic printing machine incorporating the features of the present invention therein.

For a general understanding of the illustrative electrophotographic printing machine incorporated in features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiments shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy. The conductive substrate is made preferably from aluminum which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. Drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic development system, indicated generally by the reference numeral 28, advances a developer material into contact with the electrostatic latent image. Preferably, magnetic brush development system 38 includes developer roller 40. Developer roller 40 transports a brush of developer material comprising at least carrier granules and toner particles into contact with belt 10. As shown in FIG. 1, developer roller 40 is positioned such that the brush of developer material deforms belt 10 between idler rollers 42 in an arc with belt 10 conforming, at least partially, to the configuration of the developer material. The electrostatic latent image attracts the toner particles from the carrier granules forming a toner powder image on the photoconductive surface of belt 10. The detailed structure of development system 38 will be described hereinafter with reference to FIG. 2.

After development, belt 10 advances the toner powder image to transfer station D. At transfer station D, a sheet of support material 44 is moved into contact with the toner powder image. The sheet of support material 44 is advanced to transfer station D by a sheet feeding apparatus (not shown). By way of example, the sheet feeding apparatus may include a feed roll contacting the uppermost sheet of the stack of sheets. The feed roll rotates to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes corona generating device 42 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute (not shown) guides the advancing sheet 44 to a catch tray (not shown) for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. Particles are cleaned from the photoconductive surface by the rotation of brush 56. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
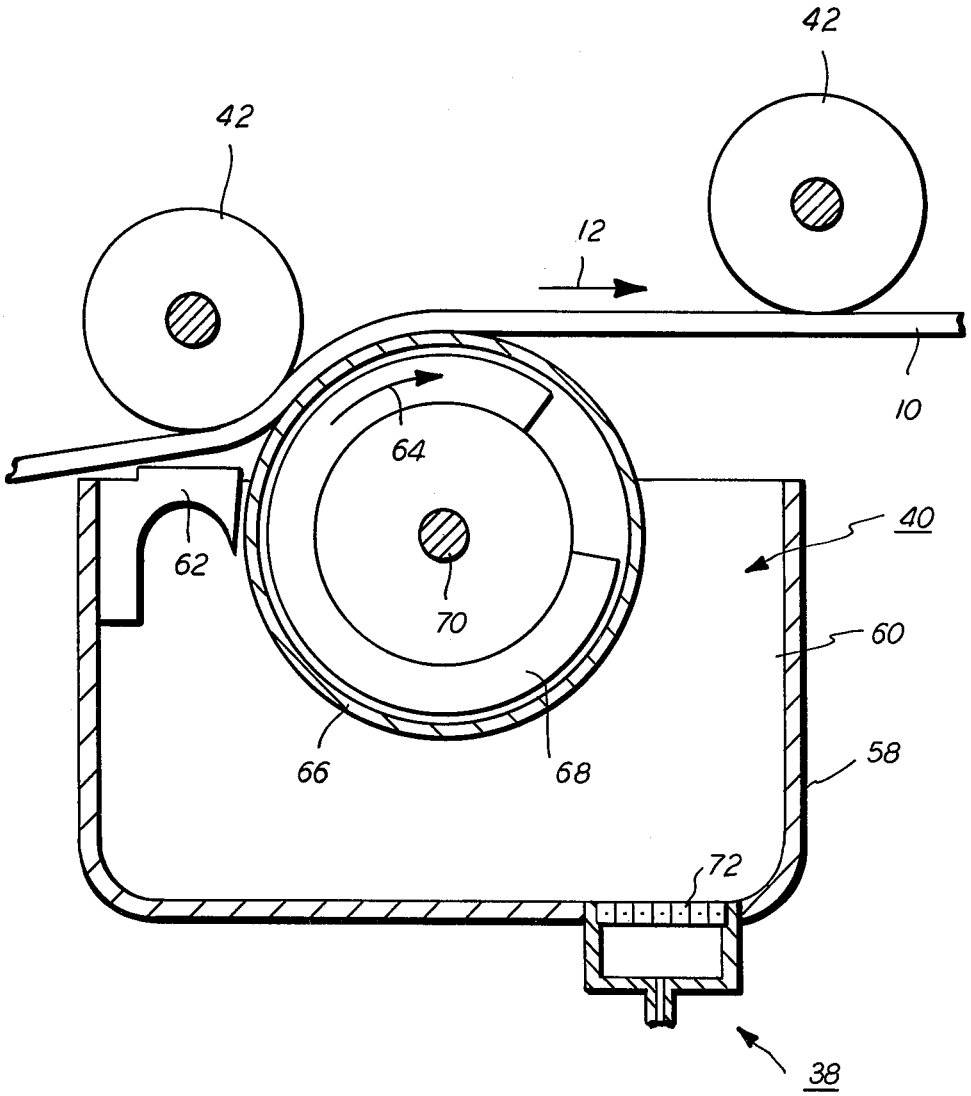
FIG. 2 is an elevational view illustrating the development system used in the FIG. 1 printing machine.

Referring now to the specific subject matter of the present invention, FIG. 2 depicts the detailed structure of development system 38. Development system 38 includes a housing 58 defining a chamber 60 for storing a supply of developer material therein. Developer roller 40 is mounted in chamber 60 of housing 58 and disposed adjacent belt 10. Developer roller 40 advances the developer material into contact with the electrostatic latent image recorded on belt 10. A metering blade 62 regulates the thickness of the developer pile height on developer roller 40. The developer material rotates in the direction of arrow 64. The thickness of the layer of developer material adhering to developer roller 40 is suitably adjusted to regulate the compressed pile height of the developer material to the desired level. Metering blade 62 extends in a longitudinal direction across the width of developer roller 40 so as to provide a substantially uniform gap controlling the quantity of material being moved into the development zone. By way of example, developer roller 40 includes a non-magnetic tubular member 66 preferably made from aluminum having the exterior circumferential surface thereof roughened. Elongated magnet 68 is positioned concentrically within tubular member 66 and mounted on shaft 70. Preferably, magnet 68 extends about 300° with the exit zone thereof being devoid of magnetic material so as to permit the developer material to fall from tubular member 66 and return to chamber 60 of housing 58 for subsequent reuse.

Tubular member 66 is electrically biased by voltage source (not shown) to a suitable polarity and magnitude. The voltage is intermediate that of the background voltage level and the image voltage level recorded on the photoconductive surface of belt 10. As tubular member 78 rotates, a brush of developer material is formed on the peripheral surface thereof. The brush of developer material advances in the direction of arrow 64, into contact with belt 10 in the development zone. This brush of developer material, in the development zone, deforms belt 10. Magnet 68 is mounted statidnarily to attract developer material to tubular member 66 due to the magnetic properties of the carrier granules having the toner particles adhering triboelectrically thereto. In the development zone, toner particles are attracted from the carrier granules to the latent image to form a toner powder image on the photoconductive surface of belt 10.

A porous filter 72 is mounted in the wall of housing 58. An exhaust fan (not shown) or any suitable blower system is connected to filter 78 to maintain a negative pressure in chamber 60 of housing 58. This draws airborne toner particles away from the photoconductive surface of belt 10 toward filter 72. The negative pressure level is selected so that it does not disturb the carrier granules but insures that there is no significant flow of air from chamber 60 of housing 58. Preferably, filter 72 is made from a sintered glass or metal. Typically, the pores in the filter have a size such that the typical airborne toner particles are larger than the pores in filter 72. A suitable filtering system of this type is described in U.S. Pat. No. 4,100,611 issued to Jugle in 1978, the relevant portions thereof being hereby incorporated into the present application.

Figure 3:
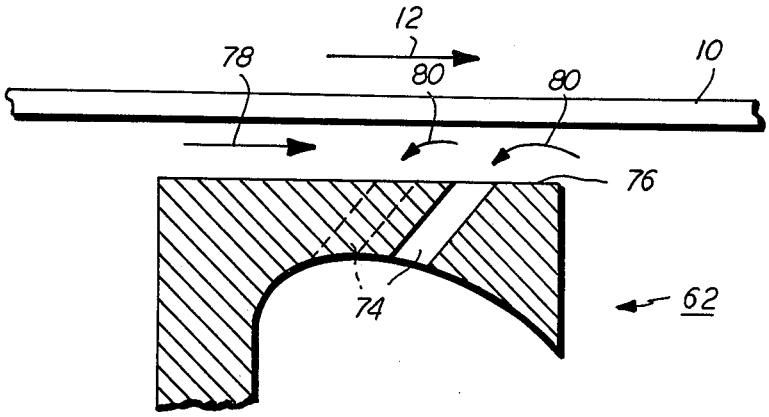
FIG. 3 is a fragmentary, elevational view depicting the blade used for controlling the thickness of the layer of developer material adhering to the developer roller used in the FIG. 2 development system.

Turning now to FIG. 3, there is shown the detailed structure of one embodiment of blade member 62. As shown in FIG. 3, blade member 62 includes a plurality of apertures 74 extending in a transverse direction relative to surface 76. As belt 10 moves in the direction of arrow 12, a flow of air inwardly into chamber 60 of housing 58 is produced. This airflow is caused by a combination of belt movement and filtering system 72 (FIG. 2). Thus, the negative pressure within chamber 60 causes air to flow in the direction of arrow 78. Furthermore, the rotation of developer roller 40 induces airflow in the direction of arrow 80. This combined airflow causes any developer material accumulating on surface 76 to flow through apertures 74 and return to chamber 60 of housing 58. Initially, developer material removed from developer roller 40 may start to accumulate on surface 76 of blade member 62. However, air flowing in the direction of arrows 78 and 80 causes any accumulated toner particles to flow through apertures 74 and return to chamber 60 of housing 58. In this way, toner particle accumulation on blade member 62 is prevented. This insures that toner particles cannot escape from chamber 60 of housing 58.

One skilled in the art will appreciate that, depending upon the surface characteristics of tubular member 66 of developer roll 40, sufficient airflow may be generated to prevent the accumulation of toner particles on blade member 62 and induce the flow thereof through apertures 74 without the use of a filtering system producing a negative pressure within the development system. Furthermore, carrier granules having toner particles adhering thereto as well as toner particles maybe induced to flow through the apertures in the blade member.

Figure 4:
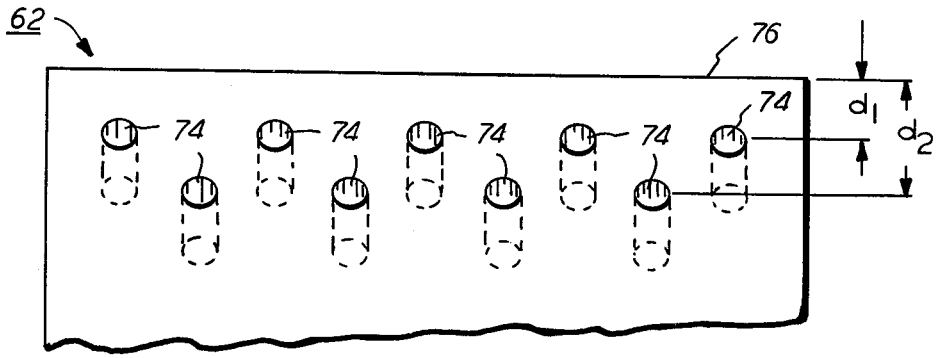
FIG. 4 is a fragmentary plan view depicting the FIG. 3 blade.

Turning now to FIG. 4, there is shown a fragmentary elevational view of blade member 62. As depicted thereat, the apertures 74 extend across blade member 62 in a direction substantially parallel to the longitudinal axis of developer roller 40. Adjacent apertures are substantially equally spaced from one another and offset or staggered from one another. In this way, two rows of apertures are formed. One row is located at a distance d1 from edge 82 of blade member 62. The second row is located a distance d2 from edge 82 of blade member 62. Preferably, each aperture 74 is cylindrical and has a diameter of about 0.125 inches. However, one skilled in the art will appreciate that the number of holes and their diameter depend upon the negative pressure maintained within chamber 60 of housing 58 and the size of blade member 62. The apertures may be slots in a case blade, as well.

Figure 5:
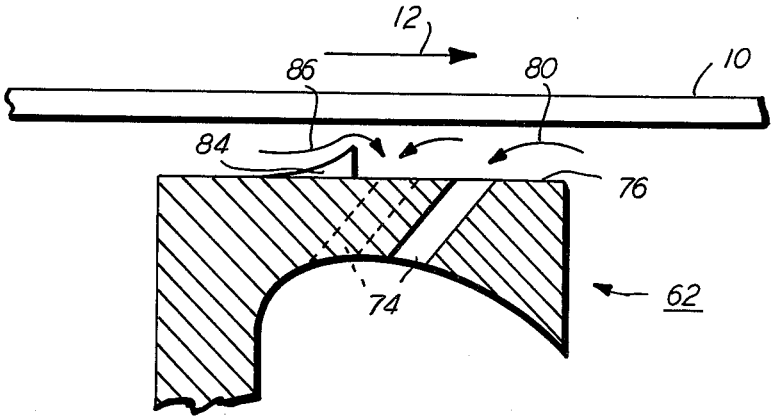
FIG. 5 is a fragmentary, elevational view depicting another embodiment of the blade used in the FIG. 2 development system for controlling the thickness of the layer of developer material adhering to the developer roller.

Referring now to FIG. 5, there is shown another embodiment of the present invention. As depicted thereat, blade member 72 includes a wedge 84, triangular in shape, secured to surface 76. Wedge 84 guides the airflow thereover in the direction of arrow 86 to further induce developer material flow through aperture 74. Wedge or deflector 84 extends across blade member 72 and is positioned on surface 76 to deflect the airflow at the boundary layer of belt 10. In this way, the airflow moves in the direction of arrow 86 inducing at least toner particle flow through aperture 74 to prevent accumulation of at least the toner particle on surface 76 of blade member 72.

In recapitulation, it is clear that the development apparatus of the present invention includes a blade member having apertures therein arranged to allow a flow of air passing therethrough to induce at least the toner particles accumulated on a surface thereof to flow therethrough. In this way, the accumulation of toner particles on the metering blade is prevented, thereby insuring that the escape of toner particles from the developer housing is minimized.

It is, therefore, evident that there has been provided in accordance with the present invention, an apparatus for developing an electrostatic latent image which minimizes the escape of toner particles therefrom. This apparatus fully satisfies the advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing an electrostatic latent image recorded on a photoconductive member, including:

means, defining a chamber, for storing a supply of developer material comprising at least carrier granules and toner particles therein;

a tubular member mounted rotatably in the chamber of said storing means for transporting the developer material closely adjacent to the electrostatic latent image recorded on the photoconductive member;

means for attracting developer material to said tubular member;

a blade member having a plurality of apertures therein with the free end portion of said blade member being spaced from said tubular member to define a gap therebetween for controlling the thickness of the layer of developer material adhering to said tubular member; and means for reducing the pressure in the chamber of said storing means so that at least the toner particles accumulating on said blade member flow through the apertures therein returning to the chamber of said storing means.

2. An apparatus according to claim 1, wherein said blade member includes at least two rows of substantially equally spaced apertures extending in a direction substantially parallel to the edge of said blade member with the apertures in one row being offset from the apertures in the other row.

3. An apparatus according to claim 2, wherein a plane defined by said blade member intersects the longitudinal axis of each aperture therein transversely.

4. An apparatus according to claim 3, further including means for guiding at least the flow of toner particles through the apertures in said blade member.

5. An electrophotographic printing machine of the type having an electrostatic latent image recorded on a photoconductive member, wherein the improvement includes:

means, defining a chamber, for storing a supply of developer material comprising at least carrier granules and toner particles therein;

a tubular member mounted rotatably in the chamber of said storing means for transporting developer material closely adjacent to the electrostatic latent image recorded on the photoconductive member;

means for attracting developer material to said tubular member;

a blade member having a plurality of apertures therein with the free end portion of said blade member being spaced from said tubular member to define a gap therebetween for controlling the thickness of the layer of developer material adhering to said tubular member; and means for reducing the pressure in the chamber of said storing means so that at least the toner particles accumulating on said blade member flow through the apertures therein returning to the chamber of said storing means.

6. A printing machine according to claim 5, wherein said blade member includes at least two rows of substantially equally spaced apertures extending in a direction substantially parallel to the edge of said blade member with the apertures in one row being offset from the apertures in the other row.

7. A printing machine according to claim 6, wherein a plane defined by said blade member intersects the longitudinal axis of each aperture therein transversely.

8. A printing machine according to claim 7, further including means for guiding at least the flow of toner particles through the apertures in said blade member.

* * * * *